United States Patent [19]

Kaneko et al.

[11] 4,316,753

[45] Feb. 23, 1982

[54] METHOD FOR PRODUCING LOW ALLOY HOT ROLLED STEEL STRIP OR SHEET HAVING HIGH TENSILE STRENGTH, LOW YIELD RATIO AND EXCELLENT TOTAL ELONGATION

[75] Inventors: Kunishige Kaneko, Tokai; Mamoru Tashiro, Chita; Nagayasu Takemoto, Toyoake; Itaru Imabayashi, Nagoya; Takashi Furukawa, Machida, all of Japan

[73] Assignee: Nippon Steel Corporation, Tokyo, Japan

[21] Appl. No.: 22,500

[22] Filed: Mar. 21, 1979

[30] Foreign Application Priority Data

Apr. 5, 1978 [JP] Japan ..... 53-39163

[51] Int. Cl.[3] ..... C21D 7/14

[52] U.S. Cl. ..... 148/12 F; 148/12.4; 148/36

[58] Field of Search ..... 148/12.4, 12 F, 36

[56] References Cited

U.S. PATENT DOCUMENTS 4,062,700 12/1977 Hayami et al. ..... 148/12 F

*Primary Examiner*—R. Dean

*Attorney, Agent, or Firm*—Toren, McGeady & Stanger

[57] ABSTRACT

A method for producing a low alloy hot rolled steel strip or sheet comprising hot rolling a steel slab at a finishing temperature not higher than the $Ar_3$ transformation temperature plus 60° C. and cooling and coiling the hot rolled strip at a temperature not higher than 500° C. The steel slab contains not more than 0.20% carbon, 0.50 to 2.50% manganese and 0.05 to 1.0% chromium and optionally contains not more than 1.0% silicon, the balance being iron and unavoidable impurities. The resultant strip or sheet has a high tensile strength of not less than 40 kg/mm$^2$, a low yield ratio of not more than 70% and an excellent total elongation of not less than 25%.

11 Claims, 2 Drawing Figures

METHOD FOR PRODUCING LOW ALLOY HOT ROLLED STEEL STRIP OR SHEET HAVING HIGH TENSILE STRENGTH, LOW YIELD RATIO AND EXCELLENT TOTAL ELONGATION

BACKGROUND OF THE INVENTION

1. Field of the Invention

The present invention relates to a method for producing a low alloy hot rolled steel strip or sheet having high tensile strength, low yield ratio and excellent total elongation.

Conventionally, high tensile strength steels have been used mostly as structural thick gauge steel plates. However, in recent years, various industries, such as, the automobile, railway and industrial machinery industries, have been increasing their use of hot rolled high tensile strength steel sheet for the purpose of weight and cost reduction.

Furthermore, the high tensile strength low alloy steel strip or sheet (herein collectively referred to as sheet) which is used in these fields is very often rigorously pressformed. Therefore, various problems are encountered with conventional high tensile strength steels. For example, they cannot be rigorously worked due to their low elongation and the precision of the formed articles produced from these materials is often unsatisfactory because of their high yield strength which causes them to warp and spring back after their deformation.

Therefore, high tensile strength steel sheet having the properties of excellent total elongation and a low yield ratio has been suggested as a material which would solve the above-mentioned problems. As a result, much work has gone into the development of this type of steel sheet because of the great need for such a product by users of steel sheet. The standards required for such steel sheet are a tensile strength of not lower than 40 kg/mm$^2$, a low yield ratio of not higher than 70%, and an elongation better than that of conventional high tensile strength steel sheet.

2. Description of the Prior Art

A typical technique for producing this kind of low yield, high tensile strength hot rolled steel sheet involves annealing hot rolled steel sheet at a temperature not lower than the $A_1$ transformation temperature and rapidly cooling it, using various heat treatment equipment, such as, a continuous annealing line, in order to lower the yield ratio. However, this type process greatly increases the production cost due to the additional heat treatment step required.

Another technique for obtaining high tensile strength sheet having the above-described qualities in the hot rolled state is by producing a dual-phase steel sheet containing a bainite structure by adding elements, such as, Mo, Ni, etc., in order to improve the hardening. The addition of such elements inevitably increases the production costs so that it is disadvantageous to use this steel material as steel sheet for automobiles or for other purposes which require a low cost sheet.

An alternative technique for producing a dual phase strip or sheet having a high tensile strength in its hot rolled state is by coiling a sheet composed of C, Mn, and Si as the essential alloying elements, i.e., what is known in the art as plain, low carbon steel, at an extremely low temperature, for example, at a temperature not higher than 300° C.

To accomplish this requires the solution of various quality problems concerned with coil configuration and cracking, problems of operational techniques, such as, obtaining an accurate coiling temperature, and problems with respect to the facilities, such as, obtaining equipment with the requisite coiling capacity.

SUMMARY OF THE INVENTION

The object of the present invention is to overcome the various disadvantages of the prior art and to provide a low cost method for producing a high tensile strength steel strip or sheet having a low yield ratio and excellent total elongation in its hot rolled state.

The method according to the present invention comprises hot rolling a low alloy steel slab which consists essentially of not more than 0.20% carbon, 0.50 to 2.50% manganese and 0.05 to 1.0% chromium, and, optionally, includes not more than 1.0% silicon with the balance being iron and unavoidable impurities at a finishing temperature of not higher than the $Ar_3$ transformation temperature plus 60° C., cooling the hot rolled steel strip, and coiling the hot rolled steel strip at a temperature not exceeding 500° C.

When it is desired to further lower the yield ratio, the hot rolling is performed at a finishing temperature selected to fall within the range within which the ferrite and austenite phases coexist.

With the process of the present invention, one can obtain a steel strip or sheet having a tensile strength of greater than about 40 kg/mm$^2$, a yield ratio of not more than 70% and a total elongation of not less than 25%.

DESCRIPTION OF THE PREFERRED EMBODIMENTS

Figure 1:
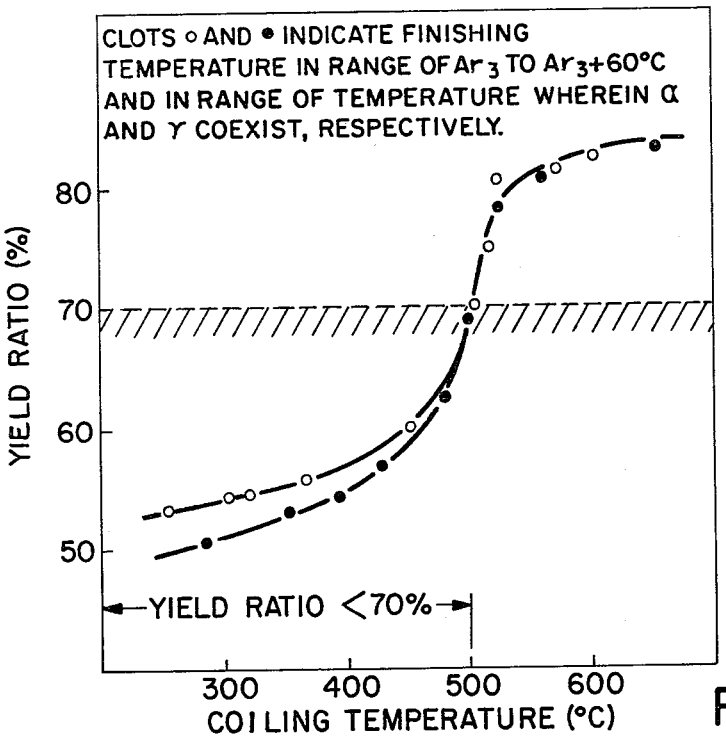
FIG. 1 shows the relationship between the yield ratio and the cooling temperature for the hot rolled sheet steel.

The reasons for various limitations in the present invention are as follows: When the carbon content exceeds 0.20%, total elongation and weldability decrease remarkably. Manganese and chromium are important elements in the present invention since, unless the steel contains at least 0.50% of manganese and 0.05% of chromium, the necessary tensile strength and the structure for obtaining the low yield ratio cannot be obtained. On the other hand, the inclusion of more than 2.5% of manganese and 1.0% of chromium results in deterioration of the total elongation and weldability, and also greatly increases the cost. Therefore, the amount of manganese is limited to 0.50 to 2.50% and the amount of chromium to from 0.05 to 1.0%.

More specifically, when the chromium content is below 0.05%, a low yield ratio cannot be obtained at a low coiling temperature, i.e., at a temperature not higher than 500° C. It is presumed that a chromium content of greater than 0.05% restricts the transformation of austenite to pearlite so that the residual austenite is maintained even at ambient temperature temperature and a desirable low yield ratio can be achieved due to mobile dislocation.

Silicon is useful for improving the tensile strength. Up to 1% may be optionally added to maintain the desirable total elongation.

To avoid any severe deterioration of the bendability and stretch-flange-formability due to inclusions, the sulfur content must be limited to a maximum of 0.015% so as to reduce the MnS inclusions. The addition to the steel of Zr, a rare earth metal (REM), e.g., La and Ce, or Ca, is effective to control the shape of the sulfide inclusions. If these elements are used, the minimum quantities to be added are those amounts necessary to change the MnS into sulfide components which are not easily hot-deformed. The upper limit of the amount of such elements is that at which the increasing oxide inclusions lower the weldability. Therefore, the amounts of Zr, REM and Ca are defined as $2 \leqq Zr/S \leqq 10$, $1.3 \leqq REM/S \leqq 5.0$ and $0.5 \leqq Ca/S \leqq 3.0$, respectively.

Nb, V and Ti may be added to the steel in order to increase the tensile strength, without deteriorating the main characteristics of the hot rolled steel strip or sheet obtained according to the present invention.

A steel having the above-described composition may be refined to a rimmed, capped, semi-killed or killed steel by use of conventional steel making methods, such as, one which employs an oxygen converter or electric furnace. The steel, thus obtained, may then be processed into slabs either by ingot-making and slabbing, or by continuous casting.

Referring now to the rolling conditions used in the process of the present invention, the slab may be heated in an ordinary slab heating furnace and then rolled, or it may be directly hot rolled. In either case, there is no limitation as to the heating temperature or the starting temperature for the hot rolling.

However, the finishing temperature of the hot rolling must not be higher than the $Ar_3$ transformation temperature plus 60° C. If the finishing temperature of the hot rolling exceeds the $Ar_3$ transformation temperature plus 60° C., the austenite grains will not be satisfactorily refined into fine grains. Furthermore, the transitional structures, including proeutectoid ferrite, which are formed due to the relatively rapid cooling following the hot rolling effected using the present day rolling facilities, produce a higher yield strength and lower workability.

When a further lowering of the yield ratio is required, the method of the present invention may be modified so that the finishing temperature of the hot rolling is limited to a temperature in the range in which the ferrite and austenite phases coexist. The reason for this is that in this range, the austenite becomes finely granulated and this promotes the transformation into ferrite so that the austenite and ferrite phases are stable within the range of temperatures in which they coexist. At the same time, the concentration of dissolved elements increases resulting in the obtaining of increased amounts of transformed bainite and martensite and residual austenite. As a consequence, the resultant product shows a low yield ratio using the normal cooling rate conventionally employed after hot rolling using presently existing manufacturing facilities.

FIG. 1 shows the yield ratio for finishing temperatures within the range in which ferrite and austenite coexist and also for finishing temperatures between $Ar_3$ and $Ar_3$ plus 60° C. for the hot rolled sheet A defined in Table 1.

The reduction rate in the range of temperatures in which ferrite and austenite coexist preferably does not exceed 40% in order to restrict the residual processing deformation.

As is clear from the examples, no particular limit need be set on the cooling rate after the hot rolling, since bainite and residual austenite can be obtained even at a cooling rate of 2° C./sec to produce the low yield ratio which is an objective of the present invention. Therefore, rolling facilities presently in existence will be satisfactory for use with the present invention.

The schedule for the cooling following the hot rolling may be modified in such a way that the hot rolled strip is kept at a temperature between its finishing temperature and 600° C. for a number of seconds and then rapidly cooled. The resultant steel strip or sheet exhibits a low yield ratio.

The coiling temperature must be limited to a maximum of 500° C., since if the hot rolled strip is coiled at a temperature above 50° C., the resultant steel will exhibit the ferrite and pearlite structure of conventional steel and have a high yield ratio due to the self-annealing which takes place after the coiling. A desirable yield ratio is one of not more than 70%, and preferably not more than 60%. However, in order to obtain a low yield ratio of not more than 60%, the coiling temperature must be limited to a maximum of 430° C. as shown in FIG. 1.

Table 1 shows the chemical compositions and the rolling conditions of a number of steel strips and sheets produced by rolling slabs to a thickness of 2.5 mm in a hot strip mill. The slabs are produced by melting the starting materials in a converter, forming the resultant molten mixture into ingots and rolling of the ingots into slabs. The rolling conditions specified are: the difference ($FT-Ar_3$) between the finishing temperature (FT) at the outlet and the $Ar_3$ transformation temperature; the average cooling rate at the run-out cooling table which is determined by three conditions (finishing temperature, coiling temperature and hot rolling speed); and the coiling temperature (CT).

In this table, steels A to L represent Al-killed steels and steels M to N represent Al-Si killed steels.

The mechanical properties of the resultant steel sheet and strips are shown in Table 2.

The tension tests were carried out using No. 5 test pieces (longitudinal direction) according to JIS Z2201 and the bending tests were carried out using test pieces (transverse direction) of 100 mm in width (with sheared edges). The limit bending radius in the bending tests was defined as being the minimum bending radius that caused cracks.

The steels A to F are within the scope of the present invention with respect to the chemical composition and the rolling conditions as well as the coiling temperature, and exhibit a high tensile strength, a low yield ratio and excellent elongation and stretchability.

Steels B, C and E exhibit particularly marked improvement in yield ratio as a result of the selection of the hot rolling finishing temperature in the range within which the ferrite and austenite phases coexist. Steels C, D and E show marked improvement in elongation and bending property due to the addition of Zr, REM and Ca. As far as the cooling rate is concerned, steel F shows a low yield ratio and excellent elongation within the scope of the present invention in spite of the average cooling rate of 2° C./sec.

Meanwhile, although steel G satisfies the composition and coiling temperature requirements of the present invention, the finishing temperature of the rolling is higher than $Ar_3+60°$ C., so that this steel does not have a low yield ratio.

Steel H is outside the range of the coiling temperature defined in the present invention, so that this steel does not show the desired low yield ratio.

The chromium contents of steels I and J are outside the ranges according to the present invention and, as a result, steel I exhibits a high yield ratio and steel J exhibits a low elongation and large limit bending radius.

The manganese contents of steels K and L are outside the ranges according to the present invention. Steel K contains too low an amount of manganese and exhibits a high yield ratio and steel L contains an excessive amount of manganese and has poor total elongation and bending property.

Steels M and N are examples of Al-Si killed steels. Steel M is within the scope of the present invention. On the other hand, steel N, while having the same composition as steel M, is outside the range of the coiling temperature according to the present invention, so that this steel exhibits a high yield ratio and low total elongation.

Figure 2:
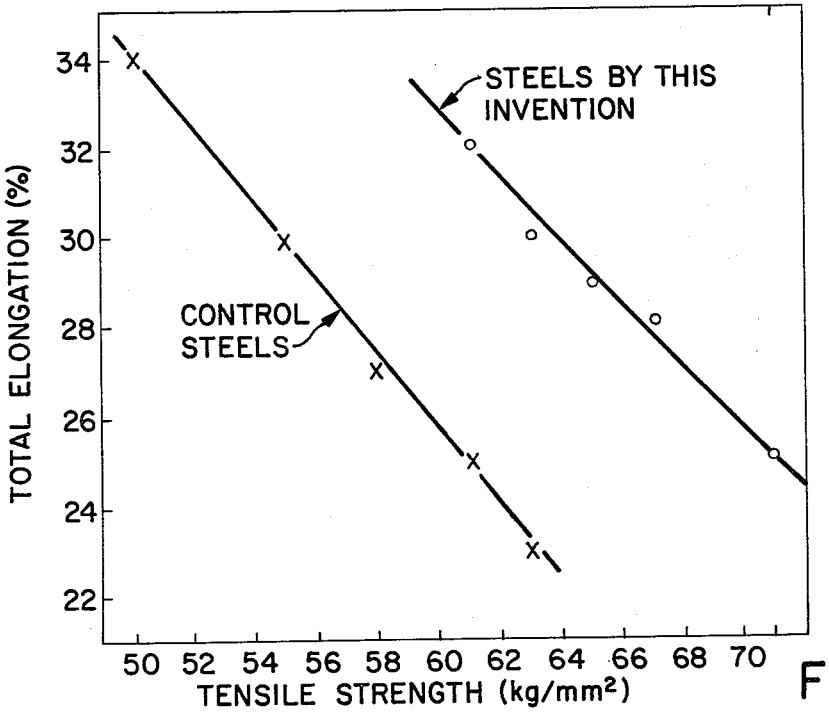
FIG. 2 shows the relationship between the total elongation and the tensile strength of each of the steel sheets of the compositions and hot rolling conditions described in Table 1.

FIG. 2 shows the total elongation of the resultant steels of the above examples in relation to their tensile strengths. It can be clearly seen that the steels according to the present invention have excellent total elongation compared with the control steels.

As described above, with the process of the present invention, a steel strip or sheet having high tensile strength, low yield ratio and excellent total elongation and which is particularly suitable for commercial production purposes can be obtained at low production costs.

TABLE 1

| Steel | | Chemical Composition (wt %) | | | | | | | | Rolling Condition | | | |
|---|---|---|---|---|---|---|---|---|---|---|---|---|---|
| | | C | Si | Mn | P | S | Cr | Al | Other Elements | (FT—Ar3) (°C.) | Average Cooling Rate (°C./Sec) | Coiling Temperature (°C.) | Ar3 (°C.) |
| A | Present Invention | 0.08 | 0.03 | 1.50 | 0.014 | 0.010 | 0.15 | 0.032 | — | 15 | 20 | 365 | 771 |
| B | Present Invention | " | " | " | " | " | " | " | — | −10 | 33 | 350 | 760 |
| C | Present Invention | " | " | " | " | " | " | " | Zr 0.040 | −20 | 26 | 300 | 765 |
| D | Present Invention | " | " | " | " | " | " | " | REM 0.018 | 40 | 24 | 300 | 768 |
| E | Present Invention | " | " | " | " | " | " | " | Ca 0.010 | −35 | 10 | 420 | 785 |
| F | Present Invention | " | " | " | " | " | " | " | — | 20 | 2 | 280 | 790 |
| G | Control Steel | " | " | " | " | " | " | " | — | 70 | 38 | 450 | 785 |
| H | Control Steel | " | " | " | " | " | " | " | — | 30 | 32 | 520 | 760 |
| I | Control Steel | 0.09 | 0.04 | 1.48 | 0.012 | 0.011 | 0.03 | 0.045 | — | 15 | 25 | 360 | 780 |
| J | Control Steel | " | " | " | " | " | 1.10 | " | — | −5 | 12 | 315 | 765 |
| K | Control Steel | 0.10 | 0.02 | 0.40 | 0.014 | 0.008 | 0.30 | 0.029 | — | 25 | 30 | 410 | 830 |
| L | Control Steel | " | " | 2.63 | " | " | " | " | — | 20 | 15 | 460 | 775 |
| M | Present Invention | 0.14 | 0.31 | 1.35 | 0.018 | 0.013 | 0.18 | 0.026 | — | −10 | 22 | 310 | 760 |
| N | Control Steel | " | " | " | " | " | " | " | — | 45 | 39 | 530 | 750 |

TABLE 2

| Steel | | Tension Test (Longitudinal Direction) | | | | Bending Test |
|---|---|---|---|---|---|---|
| | | Yield Point ($Kg/mm^2$) | Tensile Strength ($Kg/mm^2$) | Total Elongation (%) | Yield Ratio (%) | Bending Radius Limit/Thickness |
| A | Present Invention | 34 | 61 | 32 | 56 | 0 |
| B | Present Invention | 33 | 63 | 30 | 53 | 0 |
| C | Present Invention | 32 | 63 | 32 | 51 | 0 |
| D | Present Invention | 35 | 64 | 32 | 54 | 0 |
| E | Present Invention | 34 | 59 | 36 | 57 | 0 |
| F | Present Invention | 35 | 65 | 29 | 54 | 0 |
| G | Control Steel | 46 | 58 | 27 | 80 | 0.1 |
| H | Control Steel | 45 | 55 | 30 | 81 | 0 |
| I | Control Steel | 51 | 61 | 25 | 83 | 0.3 |
| J | Control Steel | 33 | 63 | 23 | 52 | 0.7 |
| K | Control | 41 | 50 | 34 | 82 | 0 |

TABLE 2-continued

| Steel | | Tension Test (Longitudinal Direction) Yield Point ($Kg/mm^2$) | Tensile Strength ($Kg/mm^2$) | Total Elongation (%) | Yield Ratio (%) | Bending Test Bending Radius Limit/Thickness |
|---|---|---|---|---|---|---|
| L | Steel Control Steel | 42 | 68 | 19 | 62 | 1.2 |
| M | Present Invention | 36 | 71 | 25 | 51 | 0.3 |
| N | Control Steel | 50 | 62 | 24 | 80 | 0.5 |

What is claimed is:

1. A method for producing a low alloy hot rolled steel strip or sheet comprising:

hot rolling a steel slab consisting essentially of not more than 0.20% carbon, 0.50 to 2.50% manganese and 0.05 to 1.0% chromium with the balance being iron and unavoidable impurities at a finishing temperature not higher than the $Ar_3$ transformation temperature plus 60° C., cooling the hot rolled steel strip or sheet, and coiling the hot rolled steel strip or sheet at a temperature not higher than 500° C., wherein said sheet or strip in the as hot rolled condition has high tensile strength of not less than 40 $kg/mm^2$, low yield ratio of less than about 60%, and excellent total elongation of not less than 25%.

2. The method of claim 1 wherein the hot rolling is performed at a finishing temperature within the range within which the ferrite and austenite phases coexist.

3. The method of claim 1 or 2 wherein the hot rolling is carried out at a reduction rate of less than about 40%.

4. The method of claims 1 or 2 wherein up to 1% of silicon is present.

5. The method of claims 1 or 2 wherein the steel contains no more than 0.015% sulfur.

6. The method of claims 1 or 2 wherein the steel contains Zr in an amount such that the ratio Zr/S is between about 2 to 10.

7. The method of claims 1 or 2 wherein the steel contains a rare earth metal in an amount such that the ratio rare earth metal/S is between about 1.3 to 5.0.

8. The method of claims 1 or 2 wherein the steel contains La or Ce in an amount such that the ratio La/S or Ce/S is between about 0.5 to 3.0.

9. The method of claims 1 or 2 wherein the steel contains Ca in an amount such that the ratio Ca/S is between about 0.5 to 3.0.

10. The method of claims 1 or 2 wherein the steel strip or sheet has a tensile strength of not less than 40 $kg/mm^2$, a yield ratio of not more than 60%, and a total elongation of not less than 25%.

11. The method of claims 1 or 2 wherein the coiling temperature is less than about 430° C. and the yield ratio of the steel is less than about 60%.

* * * * *